US007748463B2

(12) United States Patent
Revheim

(10) Patent No.: US 7,748,463 B2
(45) Date of Patent: Jul. 6, 2010

(54) CEMENTING VALVE

(75) Inventor: Sven Revheim, Hafrsfjord (NO)

(73) Assignee: Peak Well Solutions AS, Stavanger (NO)

( * ) Notice: Subject to any disclaimer, the term of this patent is extended or adjusted under 35 U.S.C. 154(b) by 0 days.

(21) Appl. No.: 12/087,670

(22) PCT Filed: Jan. 10, 2007

(86) PCT No.: PCT/NO2007/000008

§ 371 (c)(1),
(2), (4) Date: Sep. 10, 2008

(87) PCT Pub. No.: WO2007/084006

PCT Pub. Date: Jul. 26, 2007

(65) Prior Publication Data

US 2009/0000782 A1 Jan. 1, 2009

(30) Foreign Application Priority Data

Jan. 20, 2006 (NO) ..... 20060304

(51) Int. Cl.
*E21B 34/14* (2006.01)

(52) U.S. Cl. ..... 166/332.4

(58) Field of Classification Search ..... 166/177.4, 166/316, 320, 323, 332.1, 332.4, 373, 386; 251/111, 112, 341, 343
See application file for complete search history.

(56) References Cited

U.S. PATENT DOCUMENTS 3,252,383 A * 5/1966 Bowditch ..... 92/1
3,260,309 A 7/1966 Brown
3,508,573 A * 4/1970 Smith ..... 137/375

(Continued)

FOREIGN PATENT DOCUMENTS

EP 166568 A2 1/1986

(Continued)

OTHER PUBLICATIONS

International Search Report mailed Jun. 1, 2007 for International Application No. PCT/NO2007/000008.

(Continued)

*Primary Examiner*—David J Bagnell
*Assistant Examiner*—Blake Michener
(74) *Attorney, Agent, or Firm*—Wenderoth, Lind & Ponack L.L.P.

(57) ABSTRACT

A cementing valve for conducting cementing operations in a wellbore comprises a casing, wherein the cementing valve comprises an inner sliding sleeve which in a closed position covers a number of openings through an outer pipe surrounding the inner sliding sleeve, and in an open position uncovers said openings, the sliding sleeve comprising an actuating unit requiring a predetermined force to be actuated from both the closed position to the open position and vice versa, an engaging unit being arranged on the inside of the sliding sleeve for being engaged by a well running tool comprising corresponding gripping unit. The cementing valve comprises at least one shear pin designed in such a manner that a predetermined force is necessary to overcome the shear resistance of the shear pin, the sliding sleeve being arranged for moving further past the shear pin when the shear pin breaks until the actuating unit engage a groove.

4 Claims, 7 Drawing Sheets

U.S. PATENT DOCUMENTS

| | | | | | |
|---|---|---|---|---|---|
| 3,593,786 | A | * | 7/1971 | Lewis | 166/222 |
| 3,768,562 | A | | 10/1973 | Baker | |
| 4,324,293 | A | * | 4/1982 | Hushbeck | 166/317 |
| 4,399,871 | A | * | 8/1983 | Adkins et al. | 166/325 |
| 4,429,747 | A | * | 2/1984 | Williamson, Jr. | 166/321 |
| 4,474,242 | A | * | 10/1984 | Upchurch | 166/323 |
| 4,602,684 | A | | 7/1986 | Van Wormer et al. | |
| 4,669,541 | A | | 6/1987 | Bissonnette | |
| 4,928,772 | A | | 5/1990 | Hopmann | |
| 5,062,450 | A | | 11/1991 | Bailey et al. | |
| 5,299,640 | A | | 4/1994 | Streich et al. | |
| 5,316,084 | A | * | 5/1994 | Murray et al. | 166/332.4 |
| 5,335,731 | A | * | 8/1994 | Ringgenberg et al. | 166/336 |
| 5,660,234 | A | | 8/1997 | Hebert et al. | |
| 6,073,648 | A | * | 6/2000 | Watson et al. | 137/375 |
| 6,513,595 | B1 | * | 2/2003 | Freiheit et al. | 166/332.4 |
| 2003/0019630 | A1 | * | 1/2003 | Freiheit et al. | 166/332.4 |
| 2006/0185852 | A1 | * | 8/2006 | Ross et al. | 166/332.4 |

FOREIGN PATENT DOCUMENTS

| | | |
|---|---|---|
| EP | 639689 A2 | 2/1995 |
| NO | 2005 3880 | 7/2008 |
| WO | 2007/021198 | 2/2007 |

OTHER PUBLICATIONS

Written Opinion of the International Searching Authority mailed Jun. 1, 2007 for International Application No. PCT/NO2007/000008.

* cited by examiner

CEMENTING VALVE

BACKGROUND OF THE INVENTION

I. Field of Invention

The present invention relates to a device and method for carrying out cementing operations in a wellbore comprising a casing.

II. Description of Related Art

In the construction of wells, it is a requirement from The Norwegian Oil Directorate that a casing installed inside another casing must be pressure-tight before drilling is performed through the bottom of the last installed casing. During conventional cementing operations, cement is usually injected through a check valve installed at the casing bottom. In order to comply with the pressure requirements, an amount of cement is injected that is sufficient to form a column of at least 50 m height on the outside of and within the casing. The cement is then tested from within the casing using brush plugs, with the check valve at the casing bottom being closed. In order to save time, the casing is tested while the cement is still wet, and if leaks are discovered, additional cement is forced into the leak passage and a new pressure test is performed. Such cement refilling operations are technically challenging and costly, and do not always give a satisfactory result.

In some wells, it is desirable to seat the casing bottom in bedrock having less pressure than shallower rock. The cement discharged through the bottom of the casing will select the path of least resistance, in this case downwardly into the weak zone due to gravity. As a result, the minimum requirement of a cement column extending at least 50 m above bottom level will not be achieved.

In order to obtain a pressure-tight casing, it is common to install a circular valve that is threaded onto the casing 50 m above the bottom level of the casing. Often, a pressure-operated valve is used, in which case a plug is pumped down towards the valve before the cement in order to open the valve, followed by another plug behind the cement for closing the valve. Due to gravity, or driven by an applied pressure, the cement column rises to the required 50 m, so that it may be verified through a pressure test that the casing is in fact pressure-tight. The drawback of this method is that the valve needs to have a wall thickness that causes its outer diameter to exceed the outer diameter of the casing. Moreover, the rotational moment that such a valve is able to support is significantly lower than the moment required for a casing, so that this method is not suitable for applications wherein it is necessary to rotate the casing to "drill" the pipe down to the desired depth. Also, the inner diameter of such a valve is generally less than the inner diameter of the casing, which is a major disadvantage. Furthermore, the seals of these valves have shown to be unreliable, and their pressure rating is less than that for the casings, creating an undesirable weak point in the casing.

Conventional cementing valves also have the disadvantage that the valve mechanism is not isolated from the well liquids. This causes well liquids and possibly cement to penetrate into the movable parts of the valve mechanism, increases the friction, blocks cementing ports, and/or concretes stuck packers, making the valves unreliable. Further, in the conventional technology, no verification is generally obtained at the rig floor of whether or not the cementing valve is functioning properly. The valves are operated by pumping down rubber plugs in front of and behind the cement. The first rubber plug opens the valve by pushing on a sleeve valve. The second rubber plug closes the valve by pumping a sliding sleeve. Due to the complexity of the system and the fact that the work is performed at a depth of several thousand meters using high pumping rates, it is almost impossible to detect a pressure buildup verifying the opening and closing of a cementing valve. In addition, a viscous, compressible oil-based drilling mud is used, with which a delay of several minutes occurs before a pressure buildup can be seen at the rig floor. This may e.g. lead to the incorrect assumption that an adequate amount of cement has been injected into the annulus, when this is not actually the case. Subsequently, this may result in an uncontrolled blowout, which is extremely severe and costly.

In cementing operations, "mechanically operated" cementing valves are frequently used. Such valves may be installed anywhere in a casing and in any number needed in order to seal a well. The valve may be constructed so that its inner diameter equals the inner diameter of the casing and its outer diameter equals the outer diameter of the casing connectors. Currently, the conventional cementing valve design does not exhibit the same pressure rating as the casings do due to a thin wall thickness and a deficient sealing technology. Such a conventional design uses an opening and closing tool, which is used for discharging a pre-selected amount of liquid cement or another liquid through the ports of the cementing valve in order to obtain the desired pressure seal around a casing. In the prior art, the valve is opened and closed through a sleeve seal and valve ports by moving the drill string up and down. When the cementing operation has been completed, the valve is closed and a pressure test of the valve and casing may be carried out. The drill string is disengaged from the cementing valve by rotating the drill string until a tool mounted thereon is no longer locked in locking grooves of the cementing valve. It is also known to use a non-rotational up-down movement in conjunction with a friction lock to open and close the cementing valve, in which case a tool is released from an engagement with a profile of the cementing valve when a given force is applied.

The current conventional solutions suffer from the following drawbacks: The rotational moment is less than that of casing connectors and cannot be verified by calculation. This constitutes a risk in applications wherein "drilling" is performed using the pipe on which the valve is mounted. The worst conceivable scenario is that a valve is split in two parts, so that the casing is severed. The pressure rating of the prior art cementing valves is substantially less than the pressure rating of a casing. None of the prior art solutions exhibits a pre-verifiable calibrated indication on the repeatable opening and closing, or any indication at all of the position in which the individual valve is located or of which valve is actually operated. This makes the operation critical, especially in greatly deviating wells in which, due to vertical and torsional friction, it is difficult to verify the rotation or axial up-down movements at the surface. The lack of verification makes operations critical in that it is a risk of injecting cement to an undesired location, with the worst conceivable scenario being that a drill string is concrete stuck.

Another critical situation that may arise with the prior art solutions is that the valve may be opened in an uncontrolled manner in that equipment unintentionally is run past the valve. The valves are kept closed by frictional forces, that is, only frictional forces from packers and O-rings, which in many cases is not sufficient to prevent the valve from being unintentionally opened. Moreover, the prior art solutions provide no means preventing undesired fluids and solids from entering into the critical parts of the valves, which could easily cause failure of the valve function.

After the cementing job at a given location has been completed and the cementing valve may be closed, it will be desirable to drill further down towards the reservoir by means of the rotatable drill string and associated tools. In addition to that the rotating equipment may help opening the closed cementing valve, the friction between the rotating equipment and the inside of the cementing valve will mill out the inside of the cementing valve so that the material thickness of the inner sleeve of the cementing valve becomes thinner than the original thickness. This impairs the mechanical properties, which could cause the occurrence of leaks. As a worst-case scenario, the impaired mechanical properties could result in a gas leak, which may give rise to a blowout in the well. If the leaky casing cannot be tightened, the well may have to be re-drilled.

The described cementing operations are usually carried out repeatedly, as several is casings are installed within each other in a well, and each time a casing is completed, cementing must be performed. Hence, it is important to have access to equipment that allows the opening and closing operations for the cement mixture to be carried out repeatedly. It is also important that the outer walls of the pipes are level, and it is an absolute precondition that the pipe walls and the cementing valve do not form weak points in the well.

In strongly deviating (non-vertical) wells, gravity will cause the injected cement to fill the bottom of the annulus, and usually no reliable seal is obtained between the pipes in the upper part of the annulus.

U.S. Pat. No. 5,299,640 relates to a cementing device comprising cementing ports that may be opened and closed by way of a sliding valve. The valve may be opened and closed using a drive that is operated by means of suitable received signals.

The Norwegian application 2005 3880, of the same applicant, relates to a cementing valve of the above kind. The device according to the invention is characterized in that the cementing valve may be joined between casing sections, the inner and outer diameters of the cementing valves being substantially equal to the inner and outer diameter, respectively, of the casing, and the mechanical properties of the cementing valve being similar to or having a higher rating than the mechanical properties of the casing. The cementing valve includes an inner sliding sleeve which in a closed position covers a number of openings through an outer pipe surrounding the inner sliding sleeve, and in an open position uncovers said openings. The sliding sleeve includes an actuating means requiring a predetermined force for being actuated both from the closed position to the open position and vice versa, engaging means being arranged on the inside of the sliding sleeve for being engaged by a well running tool comprising corresponding gripping means.

SUMMARY OF THE INVENTION

The present invention is a development of the above invention. The objective of the present invention is to provide a device that ensures that the sliding sleeve may be permanently and verifiably locked in a closed position when the cementing job through the cementing valve has been finished. While the work is progressing through the cementing valve, however, it will still be possible to close and open the sliding sleeve repeatedly, but when the valve is no longer needed after a cementing job has been completed, a permanent and verifiable locking of the valve is desirable. It is hence an object of the present invention to provide a cementing valve having at least three verifiable positions: open, closed, and permanently locked. Thus, the difference between a closed position and a permanently locked position is that from a closed position, the valve shall be possible to reopen, whereas in a permanently locked position, the valve is indeed closed and permanently locked with no possibility of reopening.

It is another object of the present invention that the different positions are verifiable, i.e. it shall be possible, from the surface, to draw certain conclusions that the valve is in fact in the desired position (closed, open, closed and permanently locked), and that this can be unambiguously read from the surface by means of suitable equipment.

It is a further object of the present invention to provide a device that ensures that the sliding sleeve will not be able to rotate relative to the outer pipe of the cementing valve. This is related to the manner of operation of the well running tool that may be used for actuating the cementing valve to the desired position at any time. When the sliding sleeve cannot be rotated relative to the outer pipe by the rotational tool, a rotating well running tool may be used for operating the valve, the well running tool being released from the valve by rotation.

It is a still further object of the invention to provide a cementing valve that is not subject to mechanical wear from the inside.

These and other objects are achieved by means of a device and method according to the present invention, the invention being characterized by the features set forth in the independent claims. Further embodiments and advantageous features are set forth in the dependent claims.

BRIEF DESCRIPTION OF THE DRAWINGS

In the following, a detailed description of the present invention is given with reference to the accompanying drawings, in which.

DETAILED DESCRIPTION OF THE INVENTION

Figure 1A:
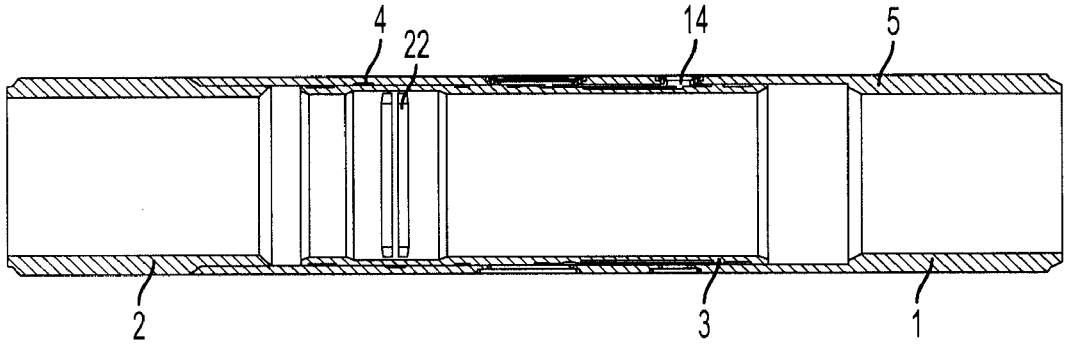
FIG. 1*a* shows a section of a cementing valve in which the valve is located in a closed position.
Figure 1B:
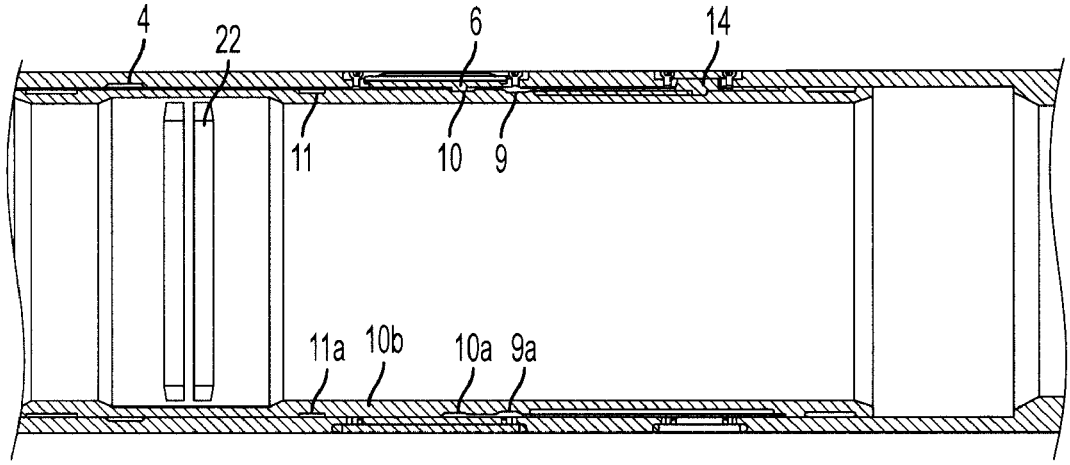
FIG. 1*b* shows a detail of FIG. 1*a,*

FIG. 1*a-b* shows an embodiment of the present invention comprising a cementing valve 1 joined between casing sections 2. The cementing valve 1 includes a sliding sleeve 3, a number of openings 4 through an outer pipe 5 of the cementing valve 1. The openings 4 are used for pumping cement from an inside located tool to the outside of pipe 2. An actuating means 6, e.g. in the form of a pre-tensioned leaf spring or another spring means comprising a pin 7 or another means of engagement, is arranged so as to be able to engage grooves 9, 10, 11 provided on the outside of the sliding sleeve 3. The grooves 11, 10, 9 correspond to an open, closed, and permanently closed and locked position, respectively. In FIG. 1-*b*, the actuating means 6 is located in the closed position, in which the pin 7 engages groove 10. Each of the grooves 9, 10 and 11 has edges/shoulders 9*a*, 10*a, b* and 11*a* having a distinct slope. The slope influences the force needed to shift the sliding sleeve from one position to another. In order to shift the sliding sleeve 3 from the closed position (in which the actuating means 6 engages groove 10) to the open position (in which the actuating means 6 engages groove 9), the sliding sleeve 3 must be pushed to the right using a force that overcomes the pre-tensioning of the leaf spring 6 as well as the slope of shoulder 10*a* of groove 10. The less slope, the less force is required. Thus, the force needed for opening the sliding sleeve 3, for example, may be determined on beforehand. In addition, various kinds of frictional coatings and/or surface structures will influence the force required to shift the sliding sleeve from one position to another. According to the present invention, it will also be possible to adapt the frictional coating and/or surface structure to achieve a desired actuating force.

Figure 2A:
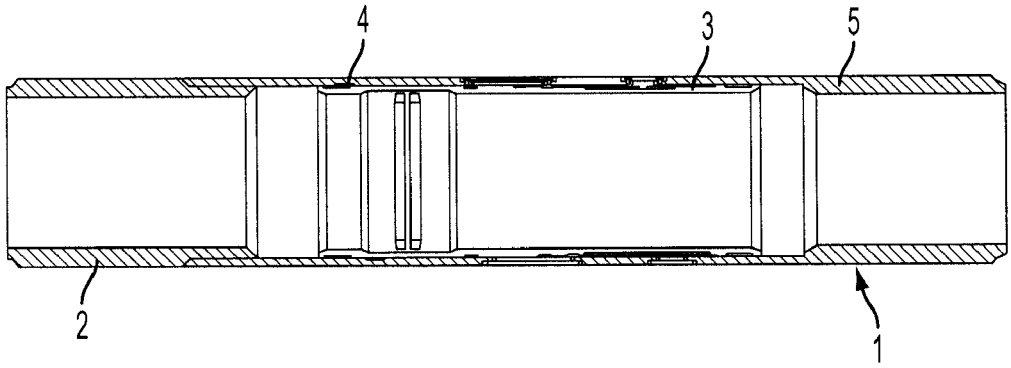
FIG. 2*a* shows a section of the cementing valve as the valve is being opened.
Figure 2B:
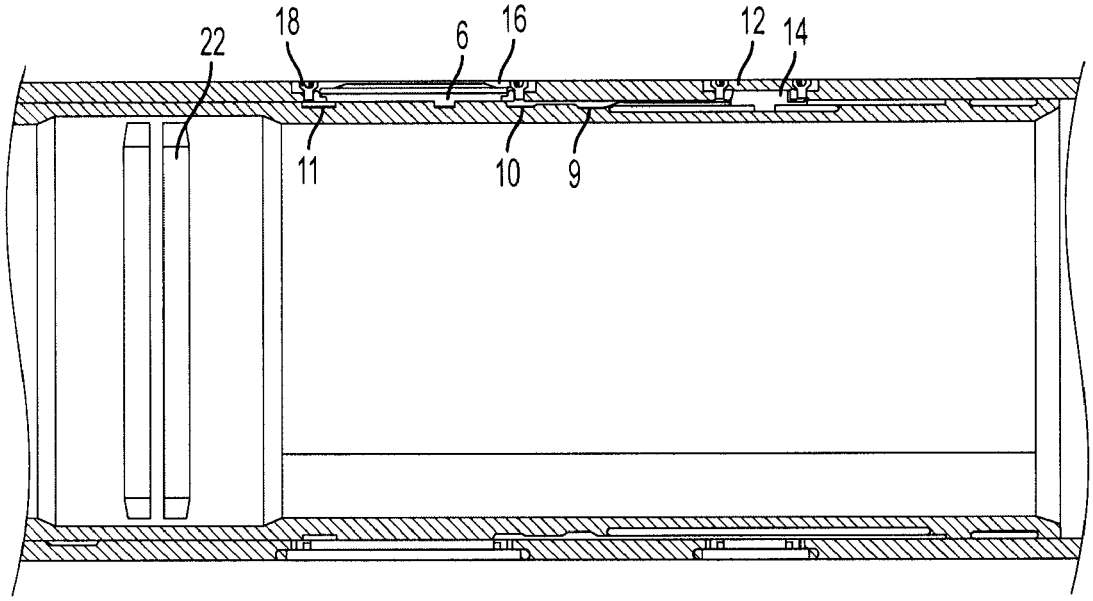
FIG. 2*b* shows a detail of FIG. 2*a,*
Figure 3A:
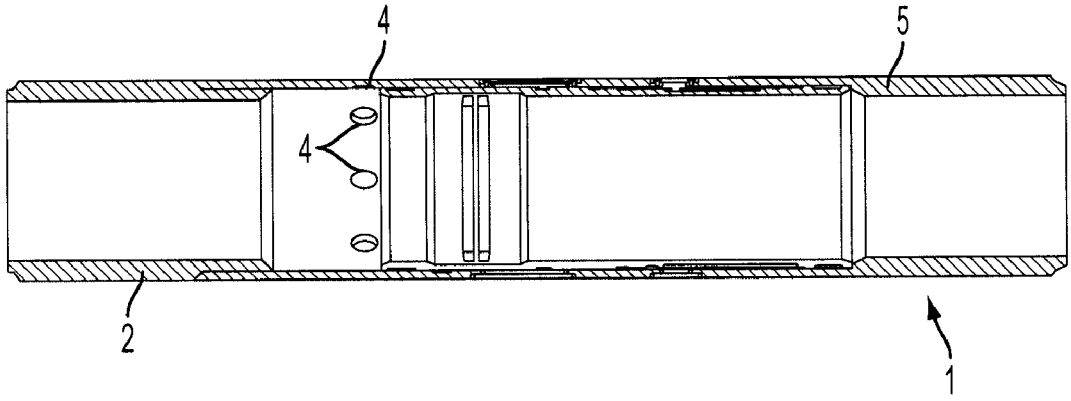
FIG. 3*a* shows a section of a cementing valve in which the valve is located in an open position.
Figure 3B:
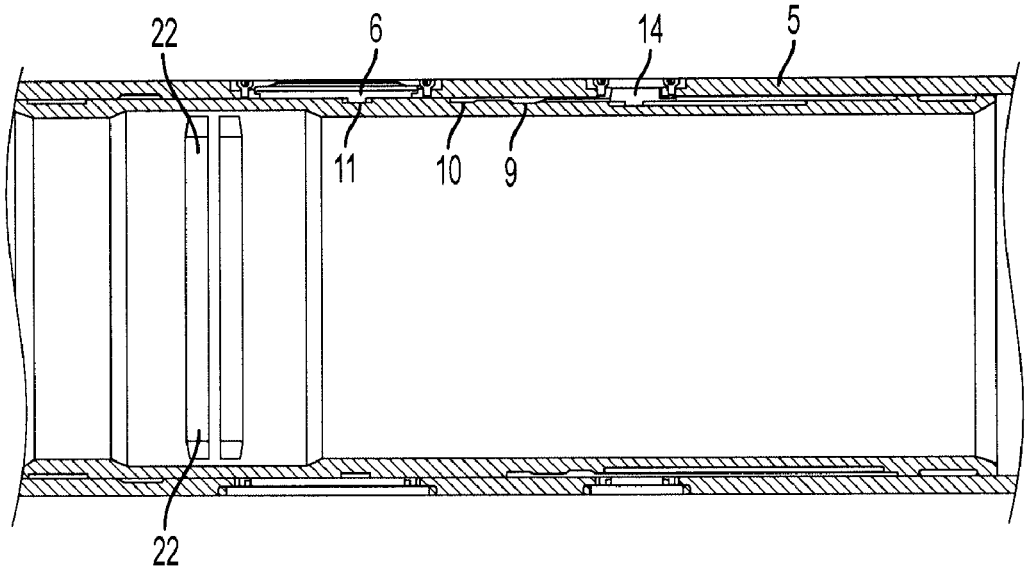
FIG. 3*b* shows a detail of FIG. 3*a,*
Figure 4A:
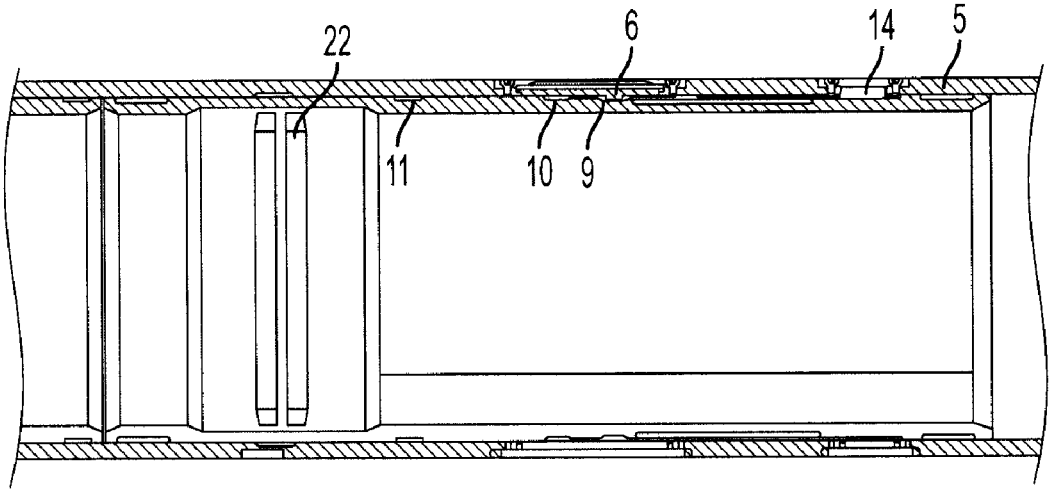
FIG. 4*a* shows a section of a cementing valve in which the valve is located in a closed and permanently locked position.
Figure 4B:
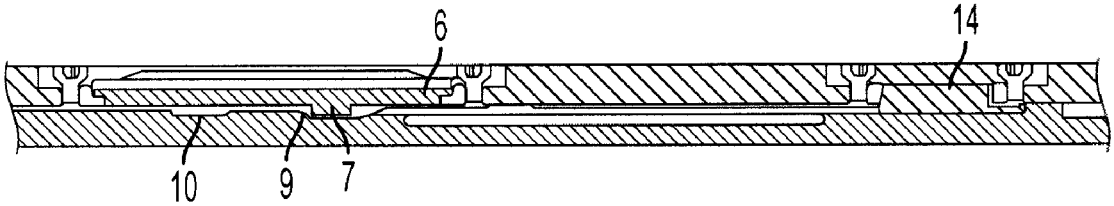
FIG. 4*b* shows a detail of FIG. 4*a,*

In FIGS. 2*a-b*, the biasing force of leaf spring 6 is overcome and leaf spring 6 is tensioned, as the pin 7 of the leaf spring 6 is located between the grooves 10, 9. By shifting the sliding sleeve further to the right, the pin 7 will finally engage groove 9, as shown in FIGS. 3*a-b*. In this position, the cementing valve 1 is open, and openings 4 are exposed from the inside so that cement may be discharged through the openings 4 into the annulus outside the cementing valve 3 and casing sections 2. The cementing valve 1 may now be opened and closed as needed by shifting the sliding sleeve forwards and backwards, so that the pin 7 engages grooves 9 and 10.

As mentioned above, the force required for opening and closing the cementing valve 1 may be determined on beforehand. This is accomplished by tuning the ratio of the slope of the shoulder to the grooves as well as the pre-tensioning of the actuating means 6. Exemplary force values needed for closing, opening, and permanently closing and locking the cementing valve may be e.g. 6, 18 and 50tons (+/−15%), respectively. It is understood that these values are exemplary only and may be varied as needed. The difference between the values should be sufficient to allow them to be unambiguously distinguished at the surface. This is important with respect to the verification at the surface. When it is desired to close the valve, the well running tool supporting the sliding sleeve 3 is pushed or pulled using a force of about 6tons. This is accomplished from the surface by increasing the force to 6 tons, after which it is monitored that the tool moves and then goes back to rest. This hence means that it may be verified that the valve 1 has been closed and that the actuating means 6 has engaged groove 10. If it is subsequently desired to reopen the valve, it is necessary, according to this particular example, to apply a force of approx. 18 tons in the opposite direction. This is carried out and again monitored from the surface, and when the force has increased to the order of 18 tons and it is registered that the tool is again moving before subsequently going back to rest, the operator knows that the valve is open and that the actuating means 6 has engaged groove 9 (This is shown in FIGS. 1*a*-3*b*)

Figure 1C:
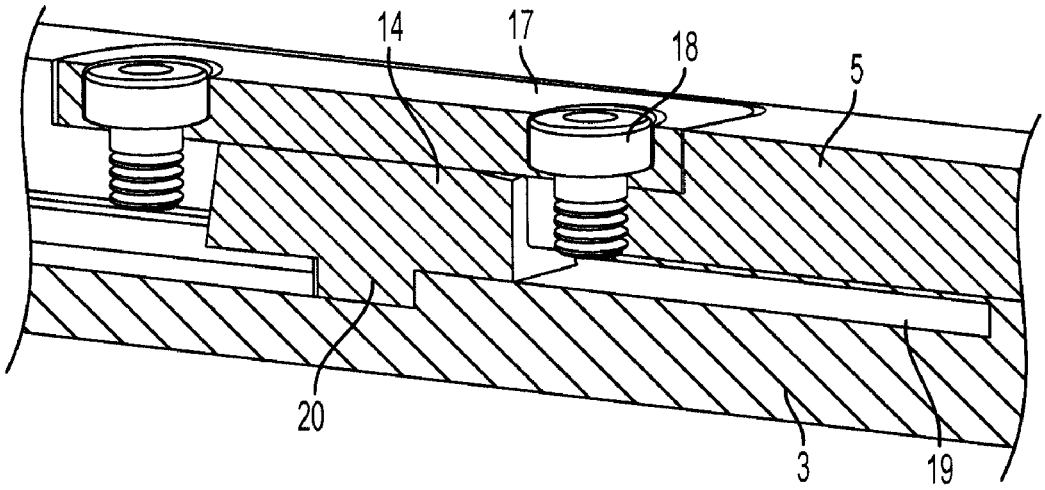
FIG. 1*c* shows a section of a shear pin/rotation preventer.

After the cementing job through a cementing valve 1 has been completed and may be finished, the valve is initially closed by following the procedure described above, after which the force will be increased further to approx. 50 tons to thereby permanently close and lock the cementing valve 1. According to the present invention, the cementing valve 1 includes one or more shear pins 14 that initially prevents the sliding sleeve from being shifted to the left (see FIG. 1*c*) all the way to the permanently locked position. However, the shear pin 14 is dimensioned so that, as combined with the biasing force of the actuating means 6 and the slope of the shoulder 13, a total force of approx. 50 tons is required to overcome the shear resistance of the shear pin 14 (FIG. 1*c*). When a force of approx. 50 tons, for example, is applied to the shear pin 14, the shear section 20 breaks, and the sliding sleeve 3 is allowed to move past the shear pin until the actuating means 6 engages groove 11. The groove 11 comprises a shoulder 9*a* having a slope of about 90°, which in practice means that the sliding sleeve 3 is now permanently locked in this position, requiring an extremely high force, in excess of 100 tons, for example, to reopen. Hence, it will not be possible to open the sliding sleeve in an uncontrolled manner.

As mentioned, the force required to permanently close and lock the cementing valve 1 depends on the shear resistance of the shear pin 14 as well as the biasing force of actuating means 6 and the slope of shoulder 11*a*. Through the use of a shear pin 14 having a higher or lower shear resistance, it is possible to increase or reduce the force required to permanently lock the cementing valve 3. According to an advantageous embodiment of the present invention, it is possible to accurately determine and tune the force required to permanently close and lock the cementing valve 3 at a work site before the equipment is carried to the well site in that the outer pipe surrounding the actuating means 6 and shear pin 14 is provided with easily opened hatches 16, 17. Following a test of the pre-tensioning of the leaf springs 6 and/or the shear resistance of the shear pin 14, the hatches 16, 17 may be opened and the leaf spring 6 and/or shear pin 14 be replaced with parts being similar, but having other parameters. The test procedure may proceed until the results are satisfactory and the desired values have been found. The hatches 16, 17 are provided with suitable fastening means 18, e.g. bolts. This embodiment allows for the easy performance of tests in order to adapt the equipment before each application without having to dispose all equipment after each test or foresee substantial effort to return the equipment to the original condition. This saves both time and cost, and also provides a flexible and applicable system.

Figure 5A:
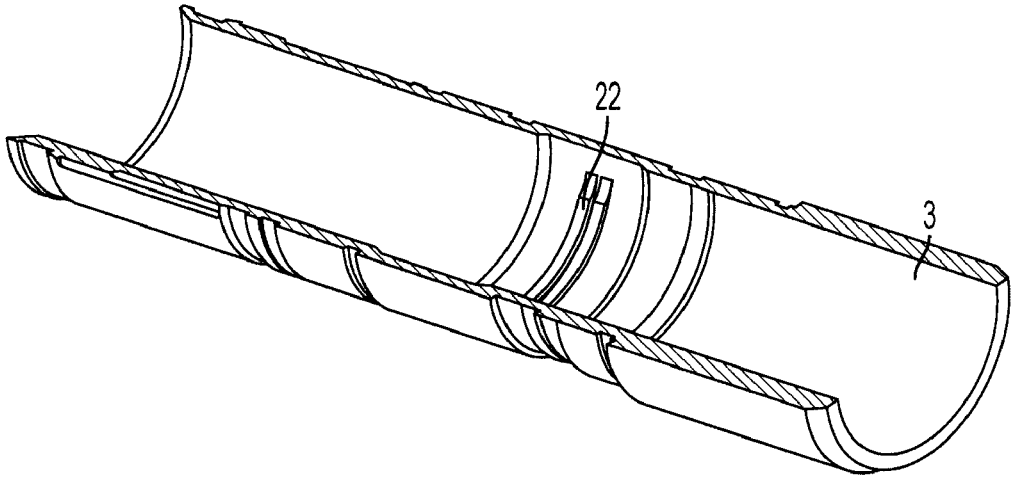
FIGS. 5*a, b* show sections of the sliding sleeve in a perspective view.
Figure 5B:
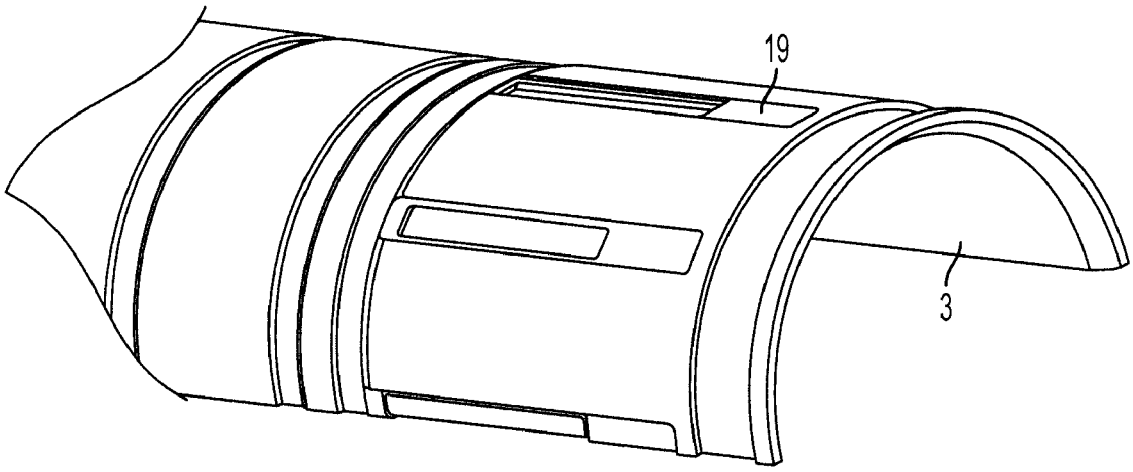
Figure 6:
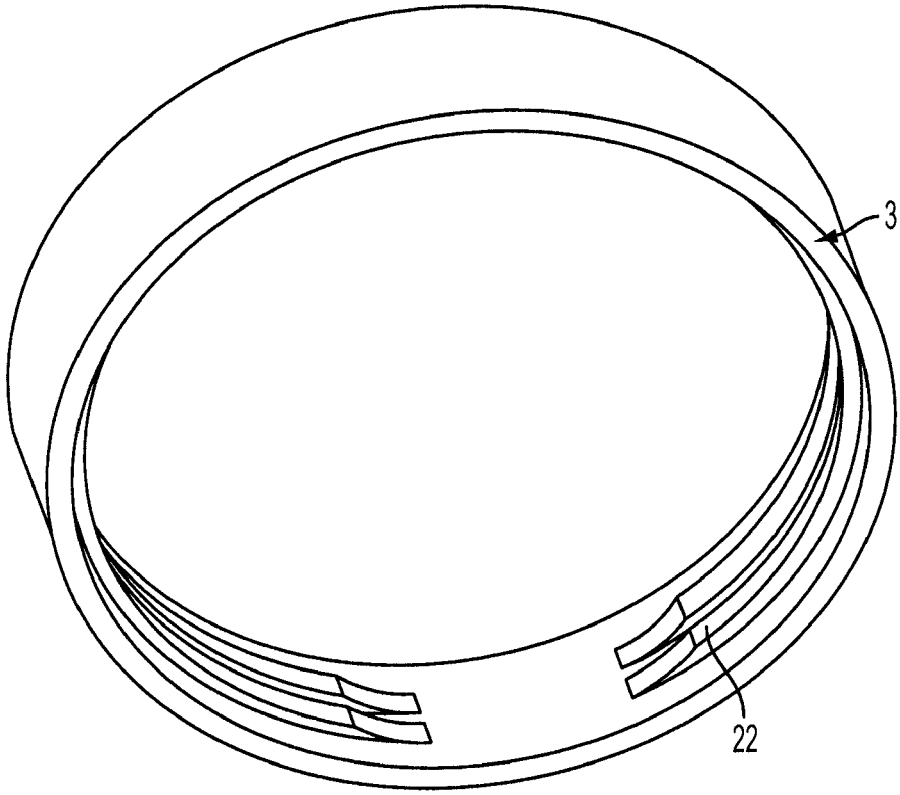
FIG. 6 shows a possible design of the edges or slots on the inside of the sliding sleeve.

According to a further advantageous embodiment of the present invention, the shear pin 14 may also act to prevent the sliding sleeve 3 from rotating relative to the outer pipe 5 of the cementing valve 3. The shear pin 14, according to this embodiment, may be shaped to run in an axially extending slot 19 of the sliding sleeve 3. As the shear pin 14 is radially fixed in the outer pipe 5 through openings or hatches 17, rotation of the sliding sleeve 3 will be prevented. Thus, the shear pin 14 comprises a shear section 20 of a sharp edge 21 in the slot 19, the shear section 20 having a predetermined shear resistance, and also includes a segment having a greater material thickness that, regardless whether or not shear section 20 is broken, remains in the slot 19 of the sliding sleeve 3 and prevents the latter from rotating (FIG. 1*c*). The purpose of this function is to allow a well running tool, having initially engaged the sliding sleeve 3 and carried out the operations necessary to complete the cementing job, to disengage from the sliding sleeve 3. On the inside of the sliding sleeve 3, one or more radially extending edges or slots 22 may be provided that do not extend over the entire inner periphery of the sliding sleeve 3 (this is shown in FIGS. 5 and 6). A well running tool may initially lockingly engage the edges or slots 22 by means of suitable claws, and when the cementing job is completed and the cementing valve 1 has been permanently closed and locked, the well running tool may be rotated to disengage the tool from the sliding sleeve 3 by rotating the claws out of the edges or slots 22. The shape of the edges or slots 22 is shown in FIG. 7, inter alia. If the sliding sleeve 3 was allowed to rotate freely, the well running tool and the sliding sleeve 3 would be left slipping against the outer pipe 5 of the cementing valve 1, failing to release the well running tool.

To make sure that no mechanical wear occurs on the inside of the cementing valve, it is possible, according to the present invention, to carry out or apply an alloy, chemical coating, mechanical surface treatment or the like ensuring that the cementing valve maintains its mechanical properties after the well has been successfully completed.

The invention claimed is:

1. A cementing valve for carrying out cementing operations in a wellbore comprising a casing, the cementing valve comprising:

an inner sliding sleeve which in a closed position covers a number of openings through an outer pipe surrounding the inner sliding sleeve, and in an open position, the inner sliding sleeve uncovers the openings, the sliding sleeve comprising an actuating means requiring a predetermined force for being actuated from both the closed position to the open position and from the open position to the closed position, and engaging means being arranged on the inside of the sliding sleeve for being engaged by a well running tool comprising a corresponding gripping means; and at least one shear pin configured such that a predetermined force is necessary to overcome the shear resistance of the shear pin, wherein the sliding sleeve is arranged so as to move further past the shear pin when the shear pin breaks until the actuating means engages a first groove, and wherein the at least one shear pin, regardless of whether or not the shear pin has been cut, is arranged to prevent the sliding sleeve from rotating relative to the outer pipe, the shear pin being shaped to run in an axially extending slot in the sliding sleeve and being radially fixed in the outer pipe.

2. The cementing valve of claim 1, wherein the at least one shear pin is accessible and replaceable through openings or hatches disposed in the outer pipe of the cementing valve.

3. The cementing valve of claim 1, wherein the first groove defines a permanently locked position, and second and third grooves define an open and closed position, respectively, each of the first, second and third grooves including a shoulder having a predetermined slope, wherein the slopes, together with the actuating means, determine the amount of force necessary to shift the sliding sleeve between one of an opened position, a closed position and a permanently locked position, the slope of the shoulder of the first groove being approximately 90°, such that that the actuating means and the sliding sleeve are permanently locked after the actuating means has engaged the first groove.

4. The cementing valve of claim 1, wherein the actuating means is arranged within the outer pipe of the cementing valve in such a manner that the actuating means is accessible and can be serviced or replaced through hatches disposed in the outer pipe of the cementing valve.

* * * * *